US006003902A

United States Patent [19]

Petkovsek

[11] Patent Number: 6,003,902

[45] Date of Patent: Dec. 21, 1999

[54] GENERIC SPECIAL SERVICE MAILING ASSEMBLY AND A METHOD FOR USING SAME

[76] Inventor: Glenn Petkovsek, 2 Saverne Cir., Little Rock, Ark. 72211

[21] Appl. No.: 08/951,455

[22] Filed: Oct. 16, 1997

Related U.S. Application Data

[63] Continuation-in-part of application No. 08/855,032, May 13, 1997.

[51] Int. Cl.[6] ..... B42D 15/00; B65D 27/00

[52] U.S. Cl. ..... 283/61; 40/638; 229/92.8; 229/300; 283/116

[58] Field of Search ..... 229/74, 92.8, 300; 40/638; 283/61, 116

[56] References Cited

U.S. PATENT DOCUMENTS

| | | | |
|---|---|---|---|
| 2,805,816 | 9/1957 | Morgan . | |
| 3,706,626 | 12/1972 | Smith et al. | 40/638 |
| 3,822,492 | 7/1974 | Crawley | 40/638 |
| 3,937,492 | 2/1976 | Biron . | |
| 3,968,927 | 7/1976 | Katz et al. . | |
| 4,368,903 | 1/1983 | Jones | 229/300 |
| 4,418,865 | 12/1983 | Bowen . | |
| 4,492,334 | 1/1985 | Dicker . | |
| 4,565,317 | 1/1986 | Kranz . | |
| 4,682,793 | 7/1987 | Walz . | |
| 4,809,905 | 3/1989 | Goodman . | |
| 4,983,438 | 1/1991 | Jameson . | |
| 5,039,652 | 8/1991 | Doll et al. . | |
| 5,044,669 | 9/1991 | Berry | 229/74 |
| 5,071,167 | 12/1991 | O'Brien . | |
| 5,183,203 | 2/1993 | Sanders | 229/300 |
| 5,190,210 | 3/1993 | Walz . | |
| 5,267,898 | 12/1993 | Doll et al. . | |
| 5,316,208 | 5/1994 | Petkovsek . | |
| 5,325,303 | 6/1994 | Walz . | |
| 5,383,686 | 1/1995 | Laurash . | |
| 5,476,420 | 12/1995 | Manning . | |
| 5,486,021 | 1/1996 | Laurash . | |
| 5,487,227 | 1/1996 | Laurash et al. . | |
| 5,501,393 | 3/1996 | Walz . | |
| 5,507,526 | 4/1996 | Petkovsek . | |
| 5,543,191 | 8/1996 | Dronzek et al. | 40/638 |
| 5,626,286 | 5/1997 | Petkovsek | 229/300 |
| 5,664,725 | 9/1997 | Walz | 229/92.8 |

*Primary Examiner*—Stephen P. Garbe
*Attorney, Agent, or Firm*—Brian M. Mattson, Patents & TMS, P.C.

[57] ABSTRACT

An assembly for mailing an article requiring delivery by a special service and a method for using the same are provided. The assembly includes a plurality of generic mailing labels having back sides adhesively and detachably affixed to a single backing sheet. Each label may be imaged with all of the information necessary to serve as one of many types of special service mailing labels. Removal of a label from the associated backing sheet allows the label to be permanently affixed to a mailpiece. Upon delivery of the mailpiece, a return receipt postcard portion of the label may be removed and forwarded to the sender of the mailpiece as a return receipt.

21 Claims, 7 Drawing Sheets

GENERIC SPECIAL SERVICE MAILING ASSEMBLY AND A METHOD FOR USING SAME

This application is a continuation-in-part application of co-pending U.S. patent application Ser. No. 08/855,032, filed on May 13, 1997.

BACKGROUND OF THE INVENTION

The present invention generally relates to a form for mailing an article requiring special services. More specifically, the present invention relates to a generic mailing label which may be configured to serve as a special service mailing label. In some embodiments, such label may be automatically dispensed by a mailing label vending machine. Indeed, the present invention also relates to a method and system for fully automating the imaging of a generic mailing label to configure the same as a special service mailing label.

It is, of course, known to provide specialized postal processing and handling of particular mailpieces. Such special services include the preparation of certified mail, registered mail, insured mail, recorded delivery mail, return receipt for merchandise mail, C.O.D. and the like. The primary disadvantage of such special service mailings is that they require a rather extensive amount of manual preparation and labor prior to mailing. The known procedures typically require printing or writing information on various slips of paper and then attaching such slips to the outside of an envelope or other mailpiece. Often, carbon paper is used to assist in making the attachments. As an example, to prepare a certified mailpiece, the forms are supplied by the United States Postal Service to the customer. The customer must separately address and complete a certified mailing receipt, both faces of a return receipt card, an envelope or mailpiece in which the mail is to be mailed and a request for return service on the face of the envelope. Then, the customer or postal service employee must affix each of the completed parts to the envelope using glue, an adhesive, tape or the like.

Clearly, the current methods known for preparing mailpieces or shipping items for special services are tedious, complicated, and labor intensive, particularly for businesses and institutions in which items such as notifications, reminders, or valuable documents are commonly sent by specialized mail services. In many instances, the delivery of such mailpieces must be documented by recording of U.S. Postal Service or other service return receipt when it arrives back to the sender. This task is also time consuming and has great potential for error when all of the identifying information from each return receipt card must be entered or recorded by hand.

Despite these shortcomings, the various special service types of mailing are still used extensively by individuals as well as companies. However, when the above-mentioned difficulties in processing such mail and preparing the same for mailing are multiplied by a large number of mailpieces, the time and labor intensive nature of preparing the special service mailings becomes quite costly and results in an inefficient use of employee time. Further complicating such procedures is the fact that different types of forms and envelopes are used for each different type of special mailing service.

A need, therefore, exists for an improved special service mailing assembly which can be prepared quite easily and which can be used for all types of special mailing services.

SUMMARY OF THE INVENTION

The present invention provides a generic mailing label which can be automatically configured to serve as a special service mailing label. In addition, the present invention provides a method for using such a special service mailing label.

In an embodiment of the present invention, a special service mailing assembly is provided for use with a plurality of mailpieces. The assembly includes a backing sheet and a plurality of mailing labels removably attached to the backing sheet and detachably connected to each other. Each mailing label includes a special service designation section identifying the respective special service. In addition, each mailing label is variably printed with information necessary to complete its respective special service wherein the information includes variable information associated with the special service printed on demand.

In an embodiment, each mailing label includes both an anchor portion and a return receipt postcard portion.

In an embodiment, the mailing assembly further includes an adhesive layer between the plurality of mailing labels on the backing sheet.

In an embodiment, each mailing label includes a special service information section containing data necessary to effect delivery by the respective special service.

In an embodiment, each mailing label includes a colored background which conforms with existing postal guidelines on color designation representative of the respective special service selected.

In an embodiment, the mailing assembly includes a plurality of return address sections on a back side of the mailing assembly wherein each return address section is associated with one of the plurality of mailing labels.

In an embodiment, the mailing assembly further includes a plurality of auxiliary labels wherein each auxiliary label is detachable from one of the plurality of mailing labels for separate affixation to the respective mailpiece.

In an embodiment, each return receipt postcard portion is detachable from the anchor portion.

In an embodiment, each mailing label includes a special service designation section for identifying both the special service and an article number for the respective mailpiece wherein the special service designation section remains on the mailpiece after attachment of the mailing label to the mailpiece.

In an embodiment, the special service designation section includes a partially-colored background conforming with existing postal guidelines on color designation representative of the special service selected.

In another embodiment of the present invention, a special service mailing assembly is provided for use with a plurality of mailpieces wherein each mailpiece requires delivery by a special service. The assembly includes a backing sheet and three mailing labels removably attached to the backing sheet wherein the mailing labels are vertically aligned and connected to each other. Each mailing label has a special service designation section identifying the respective special service. Each mailing label is also variably printed with information necessary to complete its respective special service wherein the information includes variable information associated with the special service printed on demand.

In an embodiment, the mailing assembly further includes tear lines positioned between adjoining edges of the mailing labels wherein the tear lines extend through both the mailing labels and the backing sheet.

In an embodiment, the backing sheet is 8½"×11" in size.

In an embodiment, the mailing assembly further includes three auxiliary labels wherein each auxiliary label is detachable from one of the three mailing labels for separate affixation to the respective mailpiece.

In an embodiment, the mailing assembly further includes three auxiliary tear lines wherein each auxiliary tear line is positioned between one of the three auxiliary labels and its associated mailing label. The three auxiliary tear lines extend through the backing sheet such that each auxiliary label is detachable from its associated mailing label together with an associated portion of the backing sheet.

In a further embodiment of the present invention, a method is provided for preparing an article for special service delivery. The method comprises the steps of: providing a mailing assembly having a backing sheet and three vertically aligned and connected mailing labels attached thereon wherein each mailing label is removably attached to the backing sheet and detachably connected to the other mailing labels, each mailing label also includes a return receipt postcard portion and an anchor portion wherein the return receipt postcard portion is detachably connected to the anchor portion and includes a special service designation section identifying the respective special service; indicating a special service on the return receipt postcard portion; imprinting variable information associated with the special service on the return receipt postcard portion; detaching one of the mailing labels and an associated portion of the backing sheet from a remainder of the mailing assembly; and affixing the mailing label to a mailpiece.

In an embodiment, the method further comprises the step of: providing three auxiliary labels wherein each auxiliary label is detachably connected to one of the three mailing labels and adhesively affixed to the backing sheet.

In an embodiment, the method further comprises the step of: providing a colored background on each of the three mailing labels, the color background conforming with existing postal guidelines on color designation representative of the special service selected.

In an embodiment, the method further comprises the step of: detaching one of the three auxiliary labels with a corresponding portion of the backing sheet remaining affixed thereto and retaining the auxiliary label as a customer receipt.

In an embodiment, the method further comprises the steps of: detaching one of the three auxiliary labels from a remainder of the mailing assembly; and affixing the auxiliary label to the mailpiece as an address label.

It is, therefore, an advantage of the present invention to provide an improved assembly and method for mailing an article requiring delivery by a special service.

Another advantage of the present invention is to provide an assembly and method for mailing an article requiring delivery by a special service without requiring additional adhesives or fixatives for attaching the same to a mailpiece.

Yet another advantage of the present invention is to provide an assembly including a mailing label and a backing sheet which provides for substantially automatic imaging of the variable information thereon resulting in a special service mailing label.

It is also an advantage of the present invention to provide an improved assembly which includes a plurality of mailing labels on a single 8½"×11" backing sheet.

Moreover, an advantage of the present invention is to provide a generic mailing label which may be configured to serve as one of many types of special service mailing label.

A further advantage of the present invention is to provide a simplified method for mailing an article requiring delivery by a special service.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
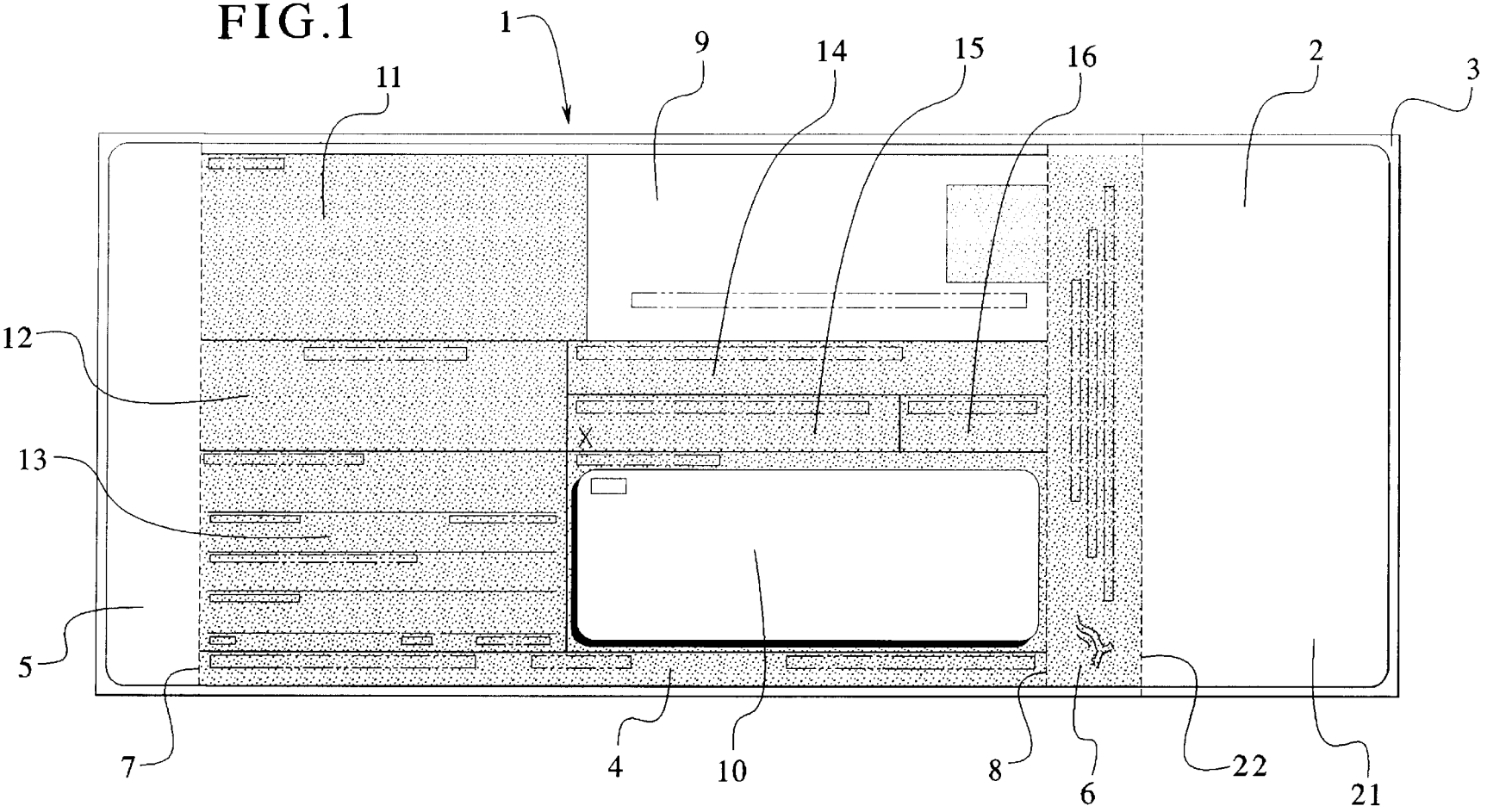
FIG. 1 illustrates a plan view of a front side of an embodiment of the mailing assembly of the present invention.

Referring now to the drawings, wherein like numerals refer to like parts, FIG. 1 is a front plan view that generally illustrates an embodiment of a mailing assembly 1 formed from a mailing label 2 and a backing sheet 3. A number of these mailing assemblies 1 may be continuously and detachably interconnected (end-to-end, for example) such that the mailing assemblies 1 may be provided on a reel or roll. The reel or roll may be provided for use with, for example, a dispensing device. The mailing label 2 may be peeled away from the backing sheet 3 whereupon the mailing label 2 subsequently may be affixed to a mailpiece. The mailing assembly 1 is capable for use in mailing an article requiring a particular type of special mailing service. Such mailing services include certified mail, insured mail, registered mail, recorded delivery mail, C.O.D., return receipt for merchandise and the like. Further, the mailing assembly 1 is intended to serve the needs of both individual users (made available, for example, at a local post office) and business users (addressing such needs as On-Demand and/or Point-Of-Sale applications).

The mailing assembly 1, in combination with the mailing label 2, forms a generic mailing label which, after imprinting, can be used for any one of a plurality of special services required for delivery of a given mailpiece. Therefore, the mailing assembly 1 may be incorporated for use in a system and method described hereinafter with reference to FIGS. 6 and 7 for any one of a plurality of special services required for delivery of a mailpiece without requiring a different form for each one of the plurality of special services generally available and offered by, for example, the United States Postal Service.

The mailing label 2 of the embodiment shown in FIG. 1 consists of four primary parts: a first anchor portion 5, a second anchor portion 6, an auxiliary label 21 and a return receipt postcard 4. The return receipt postcard 4 is removably attached to the first anchor portion 5 along a first perforated tear line 7 and removably attached to the second anchor portion 6 along a second perforated tear line 8. The significance of the detachability of the return receipt postcard 4 is discussed in more detail in connection with FIG. 4.

The return receipt postcard 4 of the mailing label 2 includes a number of information areas necessary for the proper delivery and acknowledgment of a mailpiece via a particular type of special mailing service. Specifically, the return receipt postcard 4 includes a special service identification area 9 which, pursuant to specific mailing requirements desired by a user of the mailing label 2, is imprinted with information relating to the type of special mailing service used, the individual article number for that particular mailpiece and, in some cases, a colored background which is representative of the one color that the postal service has designated for that particular type of mailing service. For example, if it is desired that a mailpiece be sent via certified mail, special service identification area 9 may include the words "CERTIFIED MAIL," a designated article number and a substantially green background. Other background colors used for the special service identification area 9 include, for example, blue for insured mail, red for registered mail and brown for return receipt for merchandise. Therefore, the mailing label 2 may be imprinted with a color on demand and/or a designation on demand; i.e., "CERTIFIED MAIL". The mailing label 2 is generic in format so that it is capable of receiving information on demand relating to the type of special service requested. Indeed, the mailing label 2 may be provided with all preprinted information omitted so as to allow the greatest flexibility for on demand form change and the inclusion of foreign text. In accordance therewith, the present invention contemplates special service circumstances wherein the return receipt postcard 4 is not used.

In addition, the return receipt postcard 4 includes an article addressee area 10 for the imprinting of the addressee's address. Such information may, if so desired, also be completed by the sender, prior to mailing, in an addressee address section 13. Both the special service identification area 9 and the article addressee area 10 may have a background color that contrasts with the color of the remainder of the return receipt postcard 4 so as to facilitate the reading of any machine-readable code which may be imprinted in these areas. Other areas, as well, may include similar color-contrasting portions.

Other information which may be imprinted on the return receipt postcard 4 includes the relevant sender information in a sender information area 11 and tracking information found in a document control area 12. Such tracking information includes, at least, a document control number bar code and a specific article number. Indeed, such tracking information is intended to include the United States Postal Service's tracking bar coding symbols which would, of course, be compatible with the Service's existing track and trace network.

Upon delivery of the relevant mailpiece, additional information may be entered on the return receipt postcard 4. Indeed, the name of the individual receiving such mailpiece may be entered in a "Received By" area 14, his or her signature entered in a signature area 15 and the date on which delivery of the mailpiece occurred entered in a "Date of Delivery" area 16.

The first anchor portion 5 and the second anchor portion 6 serve the purpose of securing the mailing label 2 to a mailpiece. The first anchor portion 5 also contains various identifier information which corresponds to that which is on the return receipt postcard 4. Specifically, the first anchor portion 5 includes the same special service mailing information which is found in the special service identification area window 9 of the return receipt postcard 4.

Similarly, the auxiliary label 21 may include the return address of the sender of the mailpiece much like that information which is found in the sender information area 11. If desired, the auxiliary label 21 may be peeled off of the backing sheet 3, detached from the second anchor portion 6 along a third perforated tear line 22 and affixed to the mailpiece 20 as a conventional return address label separate and apart from the remainder of the mailing label 2. Preferably, the back side of the auxiliary label 21 includes an adhesive that allows the label 21 to be removed from the backing sheet 3 and subsequently attached to the mailpiece. Alternatively, the auxiliary label 21 may include address information regarding to whom the mailpiece is being sent. When printed with addressee's information, the label 21 may be detached and attached to the mailpiece as a mailing label.

Yet another use of the auxiliary label 21 is as a customer receipt. The receipt may include, for example, such information as the article number, the addressee's address, the type of special mailing service used and the fees associated for such service. When used in this manner, the label 21 may not be peeled away from the backing sheet 3. Rather, that portion of the backing sheet 3 which is adhesively connected to the auxiliary label 21 may remain affixed thereto as the label 21 is detached from the rest of the mailing label 2 along perforation line 22. Of course, the auxiliary label 21, when constructed as a customer receipt, may be provided without an adhesive backing.

As mentioned above, upon delivery of the relevant mailpiece, the return receipt postcard 4 may be detached from the rest of the mailing label 2 along the first and second perforated tear lines 7 and 8, respectively. Identical identifying information is contained on both the return receipt postcard 4 and the first anchor portion 5 to aid in the accurate tracking of the mailpiece both during and after delivery.

Figure 2:
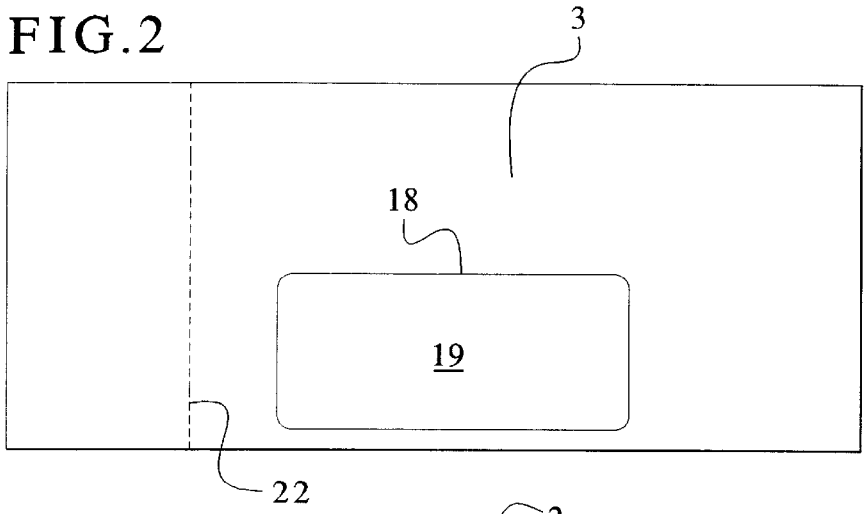
FIG. 2 illustrates a plan view of a back side of an embodiment of the mailing assembly of the present invention.

Referring now to FIG. 2, a back plan view of an embodiment of the mailing assembly 1 is illustrated. This back side consists entirely of the backing sheet 3, given that the backing sheet 3 has height and width dimensions greater than those of the mailing label 2 (see FIG. 1). The backing sheet 3 includes a frozen printable "Return To" area 19 which is scored along score/cut line 18 and which is removably separable from the rest of the backing sheet 3 so as to remain securely attached to the return receipt postcard 4. After printing an address on the frozen printable "Return To" area 19, the backing sheet 3 may be removed from the mailing label 2 without removal of the frozen printable "Return To" area 19. The combination of the backing sheet 3 with the frozen printable "Return To" area 19 provides a uniform thickness in the mailing assembly 1 which simplifies the printing of the same. Indeed, this also allows both sides of the mailing assembly 1 to be substantially simultaneously imprinted with information, if so desired. of course, the backing sheet 3 may be constructed continuously, i.e. without a frozen label, such that removal of the backing sheet 3 exposes the entire back side of the return receipt postcard 4. Still further, the backing sheet 3 may be constructed with a cut-out section at the point of the frozen label such that the printing of the return address is performed directly on the back side of the return receipt postcard 4. Also present on the backing sheet 3 is the perforation line 22 which, if it is desired that the auxiliary label 21 be used as a customer receipt, allows that portion of the backing sheet 3 which may be adhesively connected to the auxiliary label 21 to be detached from the rest of the backing sheet 3 along with the auxiliary label 21.

Figure 3:
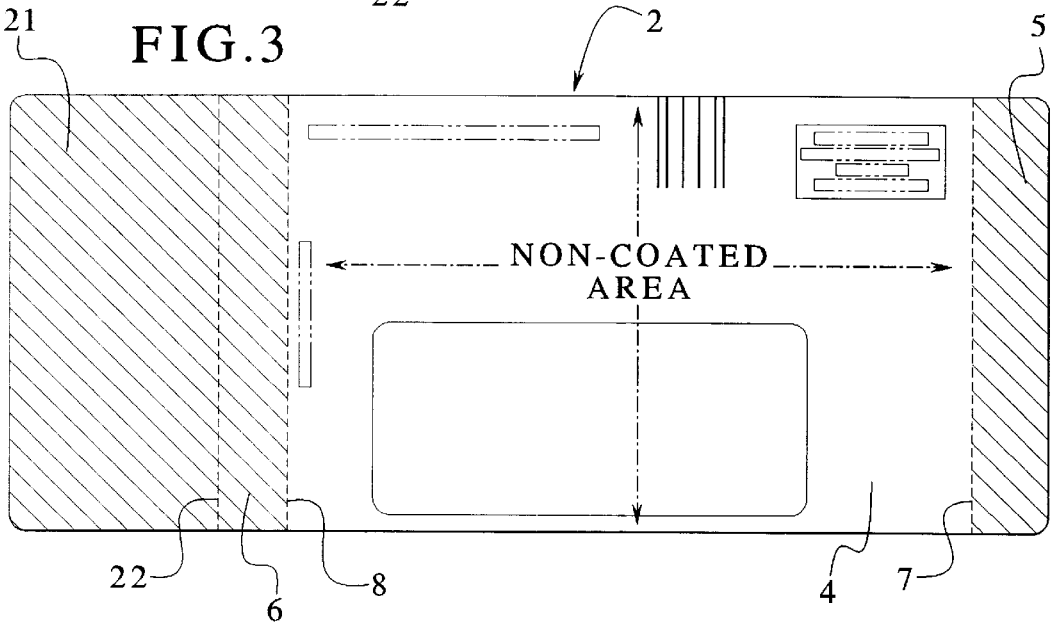
FIG. 3 illustrates a plan view of a back side of an embodiment of the mailing label removed from the mailing assembly of the present invention.

FIG. 3 shows a plan view of a back side of the mailing label 2 of the present invention after removal of the backing sheet 3 thereon. As shown, the back sides of the first anchor portion 5 and the second anchor portion 6 are covered with an adhesive coating which serves the dual purpose of removably attaching the mailing label 2 to the backing sheet 3 and, subsequently, permanently attaching the mailing label 2 to a mailpiece. The auxiliary label 21 also has an adhesive backing whereby, upon detachment from the second anchor portion 6 along the third perforated tear line 22, the auxiliary label 21 may be affixed to a mailpiece as either a conventional return address label or an addressee's label. The return receipt postcard 4, defined as that area between the first perforated tear line 7 and the second perforated tear line 8, does not include any such adhesive backing.

Figure 4:
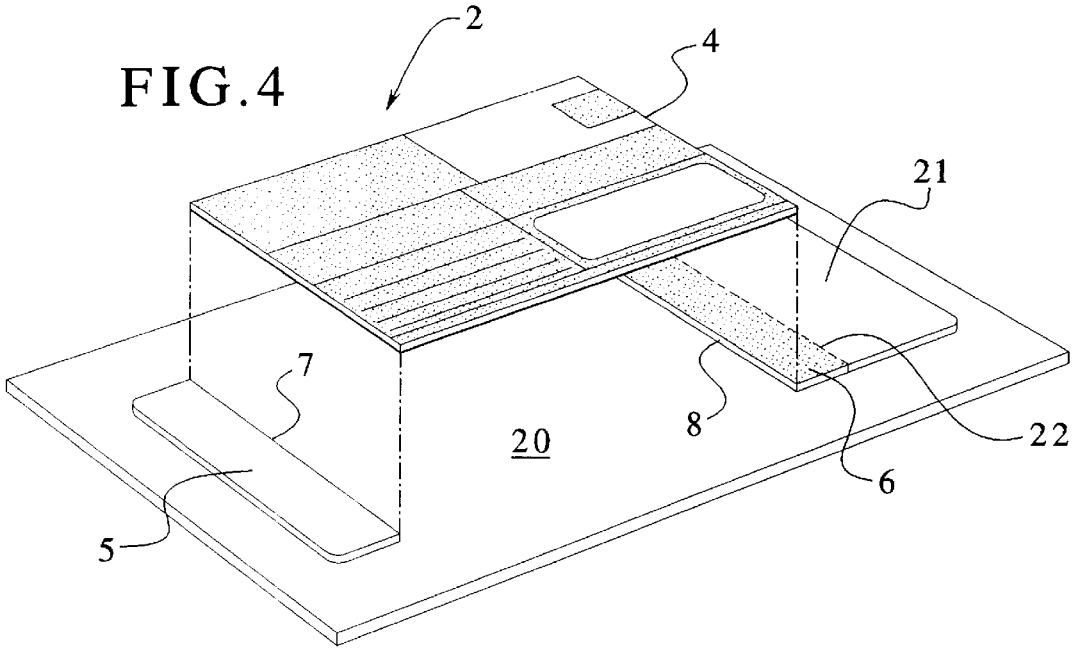
FIG. 4 illustrates a perspective view of a front side of an embodiment of the mailing label affixed to a mailpiece with a return receipt postcard of the mailing label detached from anchor portions of the mailing label.

Turning now to FIG. 4, a perspective view of a sample mailpiece 20 is shown having the mailing label 2 affixed thereupon. Actual affixation of the mailing label 2 to the mailpiece 20 is achieved via the adhesive backing found on the first and second anchor portions 5 and 6, respectively. Upon delivery of the mailpiece 20, the return receipt postcard 4 is detached from the rest of the mailing label 2 along the first and second perforated tear lines 7 and 8, respectively.

Figure 5:
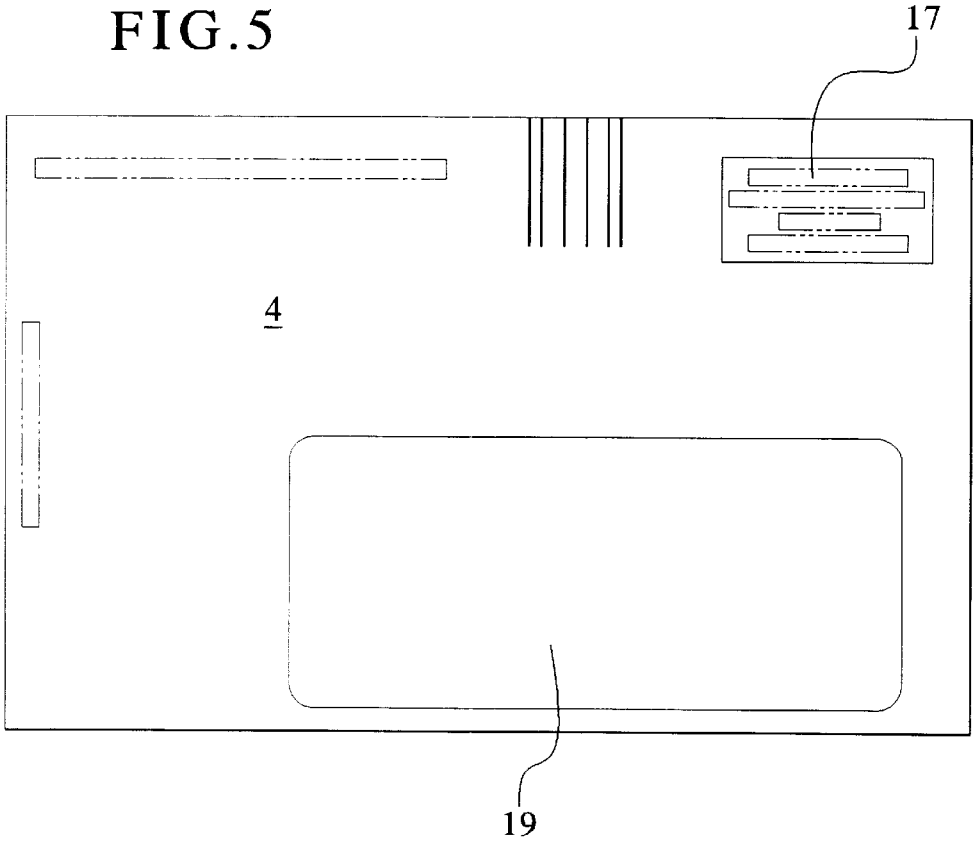
FIG. 5 illustrates a plan view of a back side of an embodiment of the return receipt postcard of the mailing label of the present invention.

FIG. 5 illustrates a plan view of the back side of the return receipt postcard 4. Information contained on this side of the return receipt postcard 4 is sufficient to allow the card to be mailed back to the proper sender. As shown, this side of the return receipt postcard 4 includes a "Return To" area 19 and a postage information area 17. Typically, the postage information area 17 is imprinted with prepaid postage information to allow for the immediate and prepaid return delivery of the return receipt postcard 4 to the proper sender.

Figure 6:
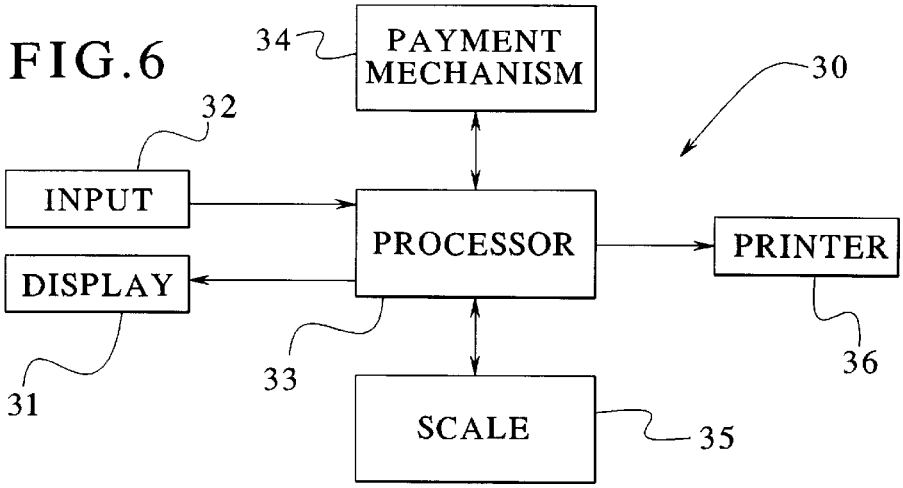
FIG. 6 illustrates a diagram of an embodiment of a system for printing and dispensing special service mailing labels of the present invention.

FIG. 6 illustrates, in black-box form, an embodiment of the system 30 of the present invention. The system 30 may, for example, be in the form of a kiosk or vending machine which processes information and prints special service mailing labels implementing the mailing label embodiments previously described. Again, the system 30 is intended to serve not only the needs of individual users (made available, for example, at a local post office) but also the needs of private businesses. The system 30 may include a display 31 by which users of the system 30 (senders of special service mailpieces) are prompted to enter certain information. These users may then both select a particular type of special mailing service and enter all of the necessary mailing information associated with such special mailing service through an input device 32. The present invention contemplates a variety of displays 31 and input devices 32 and combinations of the same, including touch screens and/or keyboards. Both the display 31 and the input device 32 are in communication with a processor 33. The processor 33 has ultimate control over the information transmitted and received via the display 31 and the input device 32.

Once all of the details of the selected special mailing service desired are confirmed, the processor 33 determines a cost associated with the selected special mailing service. Payment for such service may then be required via a payment mechanism 34. The payment mechanism 34 may include coin/bill slots, credit card readers, keypads or the like. In addition, the system 30 may include a scale 35 or other like weighing device to compute the weight of the mailpiece. The processor 33 may take such weight into consideration when determining the cost for the selected special service.

Upon payment of the required fee at the payment mechanism 34, the processor 33 instructs the printer 36 to print the necessary special service mailing information upon a generic mailing label of the present invention. As already discussed in connection with the above-referenced embodiments, such information includes both addressee and sender information and, more importantly, the special mailing service to be used, the specific article mailing number and the colored background associated with this special service. Indeed, the printer 36 has full color-printing capabilities to allow for the imprinting of a particular color on the various areas of a generic mailing label for the label's effective use as a special service mailing label. Having been configured for a special mailing service, the label may then be affixed to the desired mailpiece.

Figure 7:
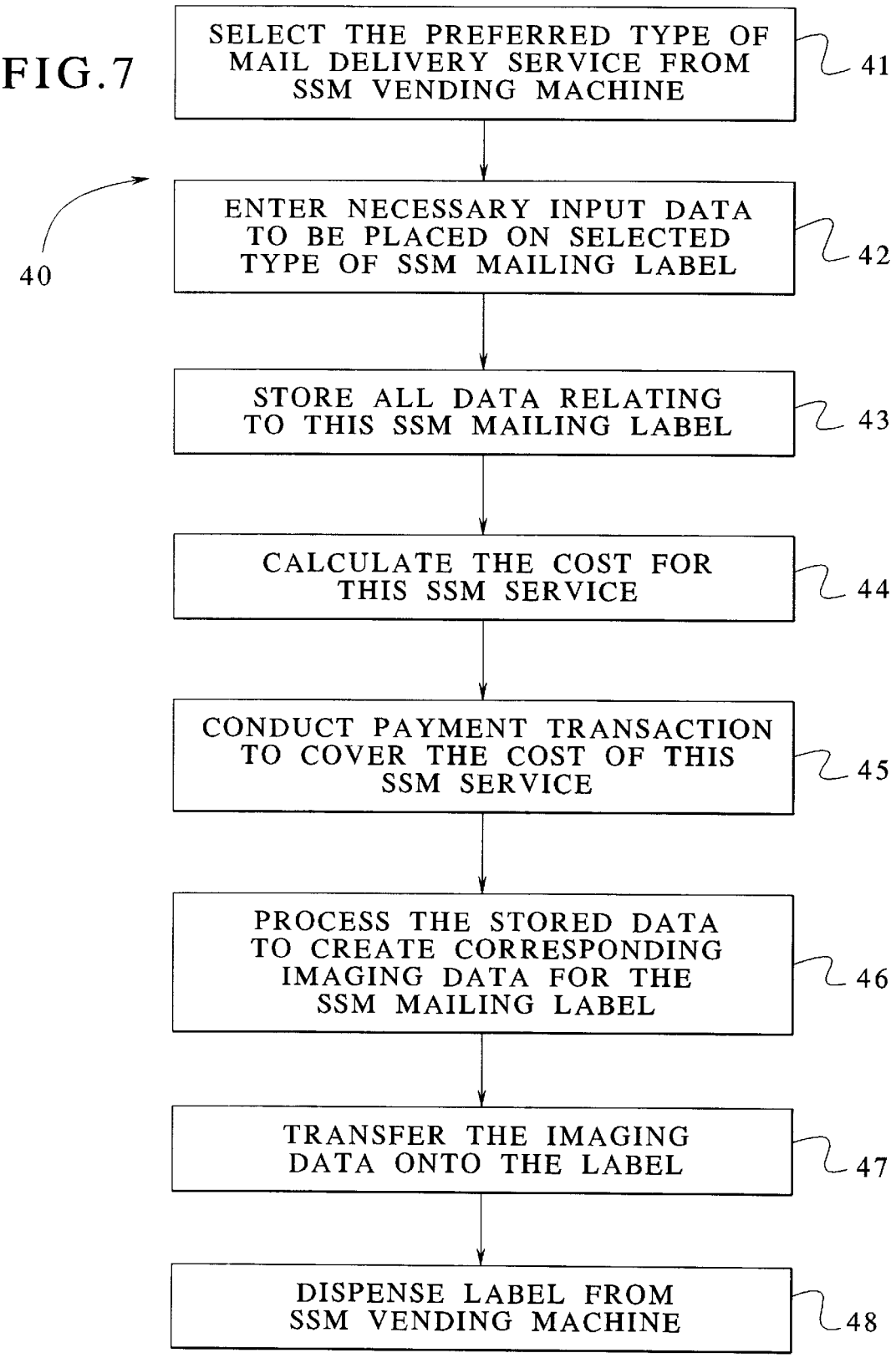
FIG. 7 illustrates a flow chart of an embodiment of a method for creating labels necessary for delivery of an article by a special service of the present invention.

Referring now to a detailed description of the method of the present invention as illustrated in an embodiment shown in the flow chart of FIG. 7, the method provides for the fully automatic imaging of a generic mailing label whereupon such label may serve a special service mailing purpose. The method may be performed using the system 30 as described above.

The method of the embodiment of the invention illustrated in FIG. 7 includes a step 41 of selecting the preferred type of mail delivery service from a Special Service Mailing (SSM) vending machine. As already discussed, such services may include certified mail, registered mail, insured mail, recorded delivery mail, return receipt for merchandise mail, C.O.D. and the like. Pursuant to the present method, a single generic mailing label, such as that illustrated with reference to FIGS. 1–5, may be configured to serve as a special service mailing label for any one type of these special services. Step 42 requires that certain input data be entered based upon the type of SSM service selected in step 41. Such input data may include the type of special service, addressee's information, sender's information and the like. Step 43 provides for the storage of all such data which relates to this particular SSM label.

Step 44 provides for the calculation of a cost for the selected SSM service. Accordingly, prior to the actual imaging of a SSM mailing label, payment for such service, if required, must be completed at step 45. The method of payment pursuant to the present invention may be, for example, an actual cash transaction, debiting of a credit card, charging to an account number via a keypad, etc. The system 30 may incorporate a scale or other like weighing device (not shown) to compute weight of the mailpiece. The cost of delivery of a mailpiece may be affected by the weight and/or size of the mailpiece, the distance in which the mailpiece is sent, and/or the type of special service. Of course, other variables may exist that affect the cost of delivery of any given mailpiece.

Step 46 provides for the processing of the stored data to create corresponding imaging data which will be printed on the SSM label. At step 47, the imaging data is actually transferred onto the mailing label. Again, such information includes both addressee and sender information and, more importantly, the special mailing service to be used, a specific article mailing number and the colored background associated with this special service. The actual transfer of imaging data at step 47 therefore includes imprinting a particular color on the various areas of the generic mailing label for the label's effective use as a special service mailing label. Once the configuration of the generic mailing label as a special service mailing label is complete, the label is dispensed from the vending machine.

Figure 8:
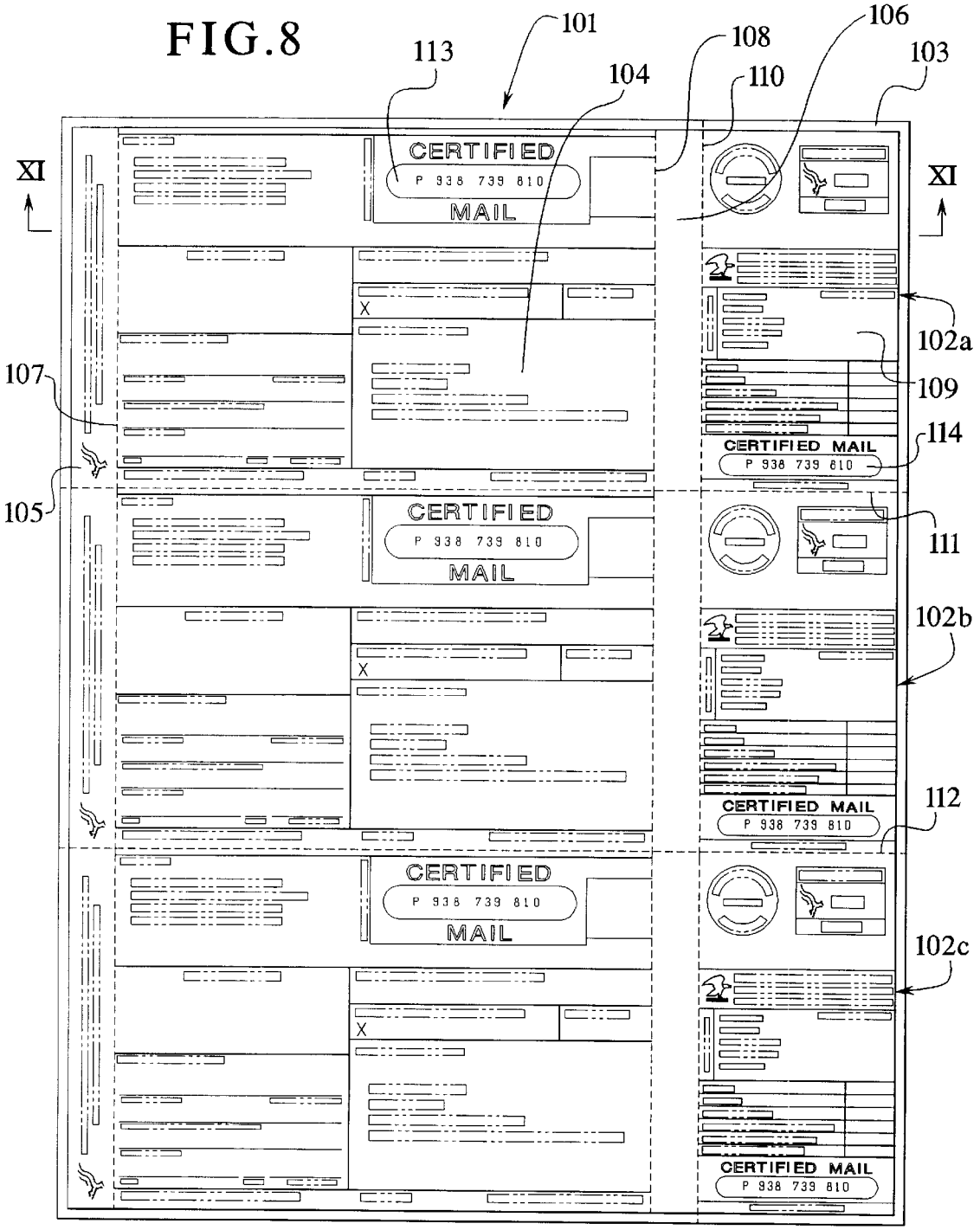
FIG. 8 illustrates a plan view of a front side of a second embodiment of the mailing assembly of the present invention.

FIG. 8 offers an alternative embodiment of the mailing assembly of the present invention. As shown in FIG. 8, a mailing assembly 101 is formed from a single backing sheet 103 and three vertically positioned and adjacent mailing labels 102*a*, 102*b* and 102*c*. Pursuant to this preferred arrangement, the backing sheet 103 may be 8½"×11" in size.

It is further shown in FIG. 8 that a fourth perforated tear line 111 separates the mailing label 102*a* from the mailing label 102*b* and a fifth perforated tear line 112 separates the mailing label 102*b* from the mailing label 102*c*. The fourth perforated tear line 111 and the fifth perforated tear line 112 extend through the entire mailing assembly 101, including both the mailing label 102 and the backing sheet 103. Accordingly, each one of mailing labels 102*a*, 102*b* and 102*c*, together with a corresponding portion of the backing sheet 103, may be separately detached from a remainder of the mailing assembly 101 along the fourth perforated tear line 111 and/or the fifth perforated tear line 112.

Each of the mailing labels 102*a*, 102*b* and 102*c* has features which are substantially similar to the embodiment shown and described in connection with FIG. 1. For example, mailing label 102*a* consists of four primary parts: a return receipt postcard 104, a first anchor portion 105, a second anchor portion 106 and an auxiliary label 109. The return receipt postcard 104 is removably attached to the first anchor portion 105 along a first perforated tear line 107 and removably attached to the second anchor portion 106 along a second perforated tear line 108. Pursuant to the present invention, the return receipt postcard 104 includes a primary special service designation section 113 which indicates the desired special service for the associated mailpiece. The primary special service designation section 113 may include an article number, a bar code identifier and/or a colored background which is indicative of the special service selected. Similarly, the auxiliary label 109 may be provided with a secondary special service designation section 114. The secondary special service designation section 114 might also include an article number, a bar code identifier and/or a colored background which is indicative of the special service selected, particularly when the auxiliary label 109 is used as a customer receipt. All other aspects of the return receipt postcard 104, the first anchor portion 105 and the second anchor portion 106 are the same as those described in connection with the embodiment shown in FIG. 1.

The auxiliary label 109 of the mailing label 102 is detachably connected to the second anchor portion 106 along a third perforated tear line 110. The auxiliary label 109 may be used as either a return address label, a separate mailing label or a customer receipt. When used as either a return address label or separate mailing label, the auxiliary label 109 may be peeled off the associated backing sheet 103, detached from the second anchor portion 106 along the third perforated tear line 110 and affixed to the respective mailpiece. Conversely, if the auxiliary label 109 is used as a customer receipt, the auxiliary label 109 is detached from the second anchor portion 106 along the third perforated tear line 110 along with its associated portion of the backing sheet 103. Indeed, when used in this manner, the auxiliary label 109 need not be peeled away from the backing sheet 103.

Figure 9:
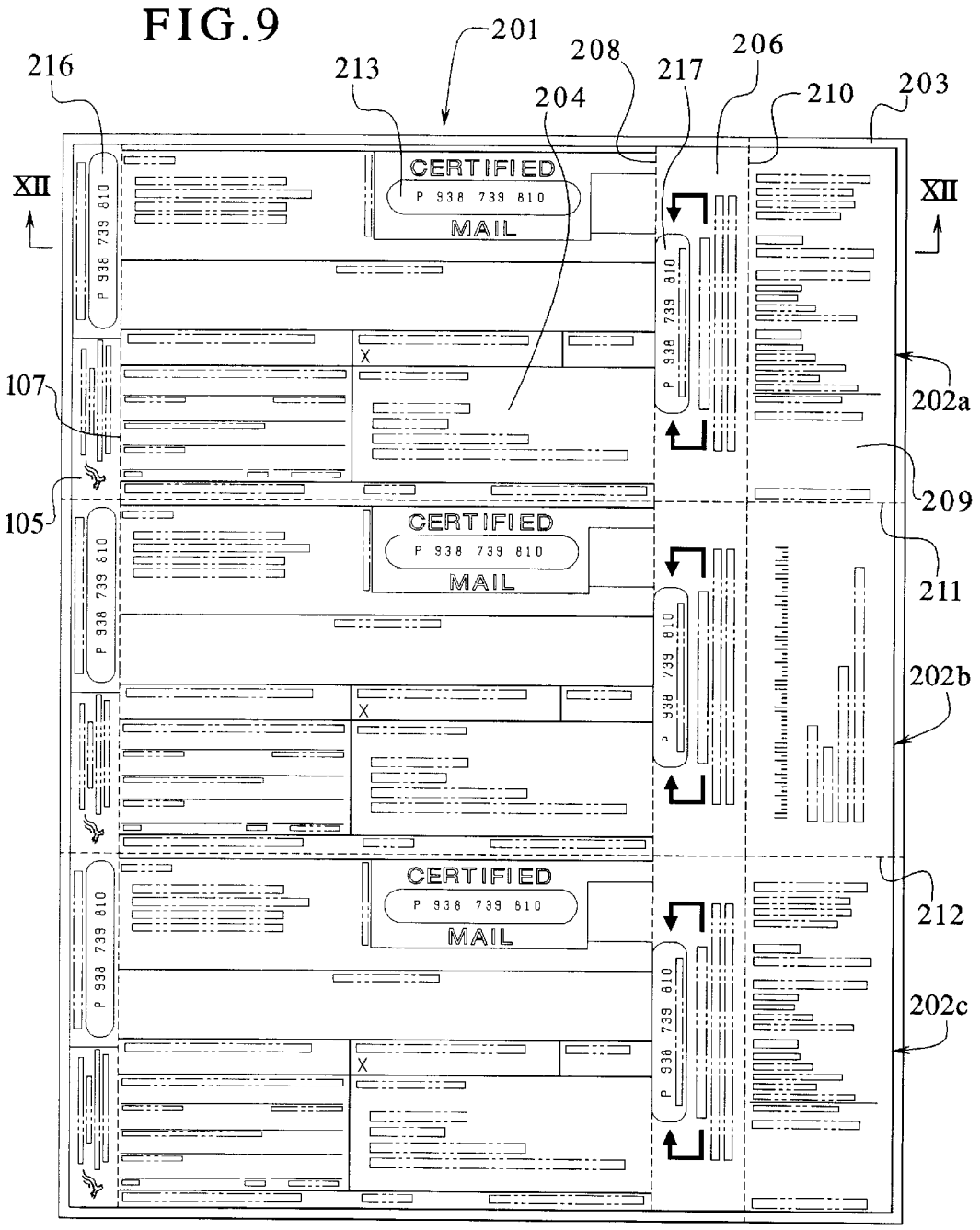
FIG. 9 illustrates a plan view of a front side of a third embodiment of the mailing assembly of the present invention.

Yet another embodiment of the present invention is shown in FIG. 9. The mailing assembly 201 in FIG. 9 consists of many of the same components as the mailing assembly 101 shown in FIG. 8 including a backing sheet 203 and three mailing labels 202*a*, 202*b* and 202*c*. Each of these mailing labels, the mailing label 202*a* for example, includes a return receipt postcard 204, a first anchor portion 205, a second anchor portion 206 and an auxiliary label 209. The return receipt postcard 204 is detachable from a remainder of the mailing assembly 201 along first perforated tear line 207 and second perforated tear line 208. Again, pursuant to the present invention, the return receipt postcard 204 includes a primary special service designation section 213 which indicates the desired special service for the associated mailpiece. The primary special service designation section 213 may include an article number, a bar code identifier and/or a colored background which is indicative of the special service selected.

The primary difference between the embodiment shown in FIG. 9 and that shown in FIG. 8 is that the mailing label 202*a* shown in FIG. 9 provides for special service designation information to be imprinted upon one or both of the first and second anchor portions 205 and 206. Specifically, the first anchor portion 205 may be provided with a secondary special service designation section 216 and the second anchor portion 206 may be provided with a secondary special service designation section 217. Secondary special service designation sections 216 and 217 might also include an article number, a bar code identifier and/or a colored background which is indicative of the special service selected. In doing so, such special service designation information remains on the relevant mailpiece even after the return receipt postcard 204 is detached therefrom after delivery.

Figure 10:
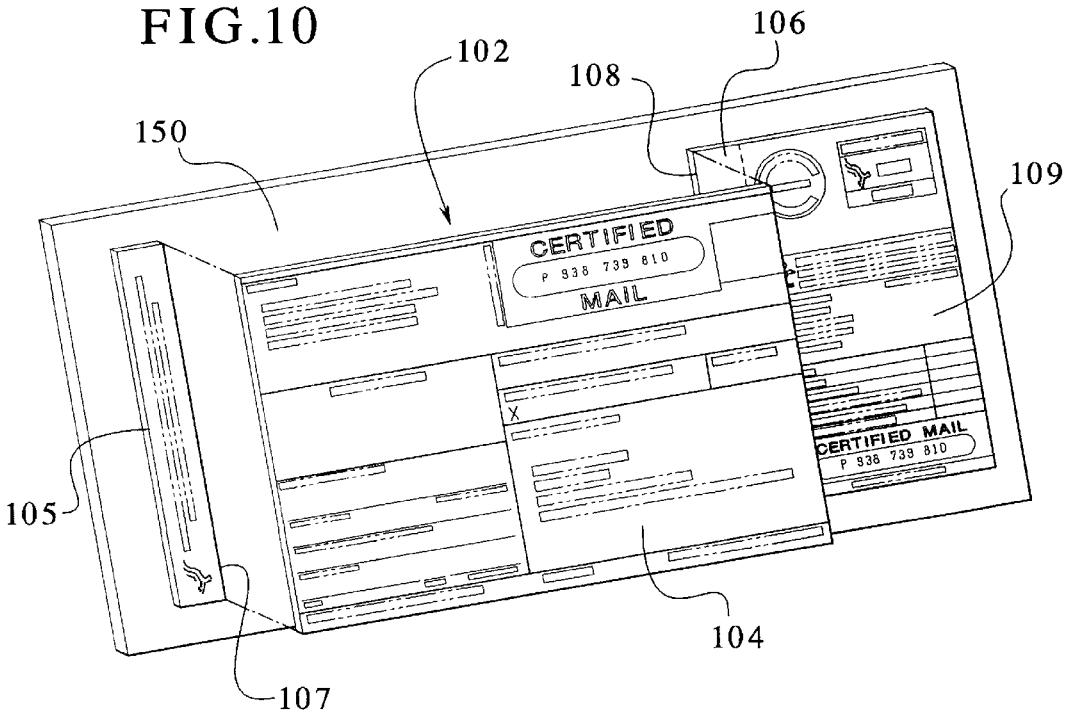
FIG. 10 illustrates a perspective view of a front side of the second embodiment of the mailing label affixed to a mailpiece with a return receipt postcard portion of the mailing label detached from anchor portions of the mailing label.

Turning now to FIG. 10, a perspective view of a sample mailpiece 150 is shown having the mailing label 102 affixed thereupon. Actual affixation of the mailing label 102 to the mailpiece 150 is achieved via the adhesive backing found on the first and second anchor portions 105 and 106, respectively. Upon delivery of the mailpiece 150, the return receipt postcard 104 is detached from the first and second anchor portions 105, 106 along the first and second perforated tear lines 107 and 108, respectively. The embodiment shown in FIG. 10 also illustrates how the auxiliary label 109 may remain attached to the second anchor portion 106 and be correspondingly affixed to the mailpiece 150. However, as already described above, this auxiliary label 109 may have been detached from the second anchor portion 106, prior to the mailing label 102 being affixed to the mailpiece 150, and retained by the sender of the mailpiece 150 as a customer receipt.

Figure 11:
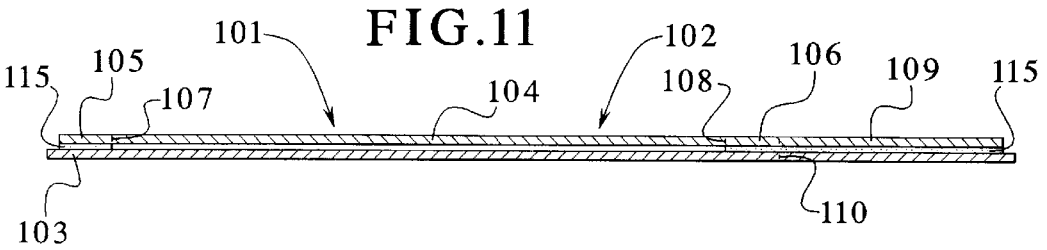
FIG. 11 illustrates a cross-sectional view of the second embodiment of the mailing assembly taken generally along lines XI—XI of FIG. 8.

FIG. 11 offers an edge view of the mailing assembly 101 from the embodiment shown in FIG. 8. As shown, the adhesive layer 115 is disposed between the backing sheet 103 and the first anchor portion 105, the second anchor portion 106 and the auxiliary label 109. The adhesive layer 115 is not disposed between the backing sheet 103 and the return receipt postcard 104.

As further shown in FIG. 11, the third perforated tear line 110 extends through both the mailing label 102 and the backing sheet 103. Conversely, the first and second perforated tear lines 107 and 108 only extend through the mailing label 102. The specific construction of the third perforated tear line 110 allows the auxiliary label 109 to be detached from a remainder of the mailing assembly 101 along with its corresponding portion of the backing sheet 103.

Figure 12:
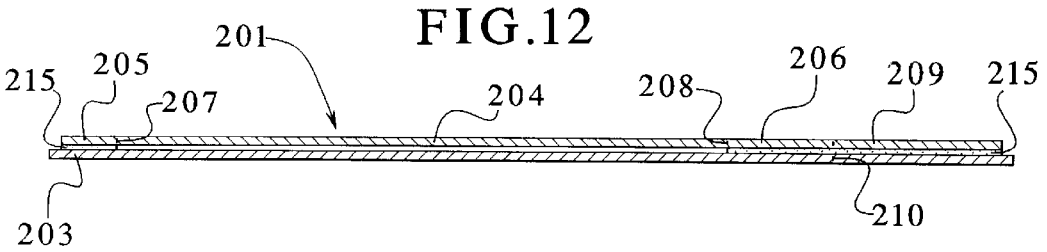
FIG. 12 illustrates a cross-sectional view of the third embodiment of the mailing assembly taken generally along lines XII—XII of FIG. 9.

FIG. 12 shows an edge view of the mailing assembly 201 from FIG. 9, much like that which is shown in FIG. 11. Again, the adhesive layer 215 is not disposed between the return receipt postcard 204 and the backing sheet 203. Rather, the adhesive layer 215 is disposed only between the backing sheet 203 and the first anchor portion 205, the second anchor portion 206 and the auxiliary label 209. The auxiliary label 209 and its associated portion of the backing sheet 203 is completely detachable from a remainder of the mailing assembly 201 along the third perforated tear line 210 which extends through both the mailing label 202 and the backing sheet 203.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the hereinafter appended claims.

I claim:

1. A mailing assembly for use with a plurality of mailpieces wherein each mailpiece requires delivery by a special service, the assembly comprising:

a backing sheet;

a plurality of mailing labels removably attached to the backing sheet and detachably connected to each other, each mailing label having a special service designation section identifying the respective special service, each mailing label being variably printed with information necessary to complete its respective special service wherein the information includes variable information associated with the special service and further wherein the information is printed on demand; and a special service information section on each mailing label including data necessary to effect the delivery by the respective special service.

2. The mailing assembly according to claim 1 further comprising:

an anchor portion on each mailing label; and a return receipt postcard portion on each mailing label.

3. The mailing assembly according to claim 1 further comprising:

an adhesive layer between the plurality of mailing labels and the backing sheet.

4. The mailing assembly according to claim 1 further comprising:

a colored background on each mailing label, the colored background conforming with existing postal guidelines on color designation representative of the respective special service selected.

5. The mailing assembly according to claim 1 further comprising:

a plurality of return address sections on a back side of the mailing assembly, each return address section associated with one of the plurality of mailing labels.

6. The mailing assembly according to claim 1 further comprising:

a plurality of auxiliary labels, each auxiliary label detachable from one of the plurality of mailing labels for separate affixation to the respective mailpiece.

7. The mailing assembly according to claim 2 wherein the return receipt postcard portion is detachable from the anchor portion.

8. The mailing assembly according to claim 1 further comprising:

a special service designation section on each mailing label for identifying both the special service and an article number for the respective mailpiece wherein the special service designation section remains on the mailpiece after attachment of the mailing label to the mailpiece.

9. The mailing assembly according to claim 8 wherein the special service designation section has a partially-colored background conforming with existing postal guidelines on color designation representative of the special service selected.

10. A mailing assembly for use with a plurality of mailpieces wherein each mailpiece requires delivery by a special service, the assembly comprising:

a backing sheet;

three mailing labels removably attached to the backing sheet wherein the mailing labels are vertically aligned and connected to each other, each mailing label having a special service designation section identifying the respective special service, each mailing label being variably printed with information necessary to complete its respective special service wherein the information includes variable information that is printed on demand and is associated with the special service; and a special service information section on each mailing label including data necessary to effect the delivery by the respective special service.

11. The mailing assembly according to claim 10 further comprising:

tear lines positioned between adjoining edges of the mailing labels, the tear lines extending through both the mailing labels and the backing sheet.

12. The mailing assembly according to claim 10 wherein the backing sheet is 8½"×11" in size.

13. The mailing assembly according to claim 10 further comprising:

three auxiliary labels, each auxiliary label detachable from one of the three mailing labels for separate affixation to the respective mailpiece.

14. The mailing assembly according to claim 13 further comprising:

three auxiliary tear lines, each auxiliary tear line positioned between one of the three auxiliary labels and its associated mailing label and extending through the backing sheet wherein each auxiliary label is detachable from its associated mailing label together with an associated portion of the backing sheet.

15. A method for preparing an article requiring delivery by a special service, the method comprising the steps of:

providing a mailing assembly having a backing sheet and three vertically aligned and connected mailing labels attached thereon, each mailing label removably attached to the backing sheet and detachably connected to the other mailing labels, each mailing label including a return receipt postcard portion and an anchor portion wherein the return receipt postcard portion is detachably connected to the anchor portion and includes a special service designation section identifying the respective special service, each of the mailing labels having a special service information section that includes data necessary to effect the delivery by the respective special service;

indicating the special service on the return receipt postcard portion;

imprinting variable information associated with the special service on the return receipt postcard portion;

detaching one of the mailing labels and an associated portion of the backing sheet from a remainder of the mailing assembly; and affixing the mailing label to a mailpiece.

16. The method of claim 15 further comprising the step of:

providing three auxiliary labels, each auxiliary label detachably connected to one of the three mailing labels and adhesively affixed to he backing sheet.

17. The method of claim 15 further comprising the step of:

providing a colored background on each of the three mailing labels, the colored background conforming with existing postal guidelines on color designation representative of the special service selected.

18. The method of claim 16 further comprising the step of:

detaching one of the three auxiliary labels with a corresponding portion of the backing sheet remaining affixed thereto and retaining the auxiliary label as a customer receipt.

19. The method of claim 16 further comprising the steps of:

detaching one of the three auxiliary labels from a remainder of the mailing assembly; and affixing the auxiliary label to the mailpiece as an address label.

20. A method for preparing an article requiring delivery by a special service, the method comprising the steps of:

providing a mailing assembly having a backing sheet and three vertically aligned and connected mailing labels attached thereon, each mailing label removably attached to the backing sheet and detachably connected to the other mailing labels, each mailing label including a return receipt postcard portion and an anchor portion wherein the return receipt postcard portion is detachably connected to the anchor portion and includes a special service designation section identifying the respective special service;

indicating the special service on the return receipt postcard portion;

imprinting variable information associated with the special service on the return receipt postcard portion;

detaching one of the mailing labels and an associated portion of the backing sheet from a remainder of the mailing assembly;

affixing the mailing label to a mailpiece;

providing three auxiliary labels, each auxiliary label detachably connected to one of the three mailing labels and adhesively affixed to the backing sheet; and detaching one of the three auxiliary labels with a corresponding portion of the backing sheet remaining affixed thereto and retaining the auxiliary label as a customer receipt.

21. A method for preparing an article requiring delivery by a special service, the method comprising the steps of:

providing a mailing assembly having a backing sheet and three vertically aligned and connected mailing labels attached thereon, each mailing label removably attached to the backing sheet and detachably connected to the other mailing labels, each mailing label including a return receipt postcard portion and an anchor portion wherein the return receipt postcard portion is detachably connected to the anchor portion and includes a special service designation section identifying the respective special service;

indicating the special service on the return receipt postcard portion;

imprinting variable information associated with the special service on the return receipt postcard portion;

detaching one of the mailing labels and an associated portion of the backing sheet from a remainder of the mailing assembly;

affixing the mailing label to a mailpiece;

providing three auxiliary labels, each auxiliary label detachably connected to one of the three mailing labels and adhesively affixed to the backing sheet;

detaching one of the three auxiliary labels from a remainder of the mailing assembly; and affixing the auxiliary label to the mailpiece as an address label.

* * * * *